United States Patent [19]

Foreman

[11] Patent Number: 4,762,034

[45] Date of Patent: Aug. 9, 1988

[54] CONSTRICTOR LOCK WRENCH SYSTEM

[76] Inventor: Howard R. Foreman, Rte. 1, Box 184, Miami, Okla. 74354

[21] Appl. No.: 11,264

[22] Filed: Feb. 5, 1987

[51] Int. Cl.[4] ..... B25B 13/28

[52] U.S. Cl. ..... 81/111; 81/117; 81/424; 269/157

[58] Field of Search ..... 81/100, 90.3, 90.9, 81/94, 97, 100, 111, 117, 418, 421, 424, 185–186; 269/249, 157, 163, 212, 218

[56] References Cited

U.S. PATENT DOCUMENTS

| | | | |
|---|---|---|---|
| 1,109,766 | 9/1914 | Landon | 81/185.1 |
| 1,512,363 | 10/1924 | Phleger | 81/185.2 |
| 2,707,412 | 5/1955 | Brame | 81/185.2 |

*Primary Examiner*—Frederick R. Schmidt
*Assistant Examiner*—Maurina Rachuba
*Attorney, Agent, or Firm*—Head & Johnson

[57] ABSTRACT

This is a constrictor wrench which can compensate for a wrench not being the exact fit to match the nut or object which it is to rotate or hold. The wrench has a first jaw and a second jaw with the face of the first jaw modified so that it has a recess which is substantially arcuate in shape and contour. A swinging jaw is provided which has one edge having a contour matching with the contour of the first jaw. The second edge of the swinging jaw is planar. A pressure arm connects the swinging jaw to the first fixed jaw. Biasing means are provided against the pressure arm to force the swinging jaw along the arcuate face of the top jaw away from the mouth of the wrench.

10 Claims, 4 Drawing Sheets

CONSTRICTOR LOCK WRENCH SYSTEM

BACKGROUND OF THE INVENTION

1. Field of the Invention:

This relates to a wrench system for rotating polygon shaped members such as squares, hexagons and octagons. These members are used in the form of bolts or nuts.

2. Prior Systems:

Wrenches have been used for a long time to either remove or tighten a nut on a bolt or to rotate certain type screws. Many existing wrenches include adjustable jaw wrenches so that various side members may be rotated. These adjustable jaw wrenches may be wrenches which have a flat faced upper jaw which is opposite the flat face of a lower movable jaw. Other adjustable wrenches includes the so-called pipe wrenches in which the opposing faces of the upper and lower jaws are serrated so that they can bite into a pipe. Other wrenches are in a class called end wrenches in which the jaws are a fixed distance apart. When fixed wrenches such as end wrenches are used it is most important that the distance between the two jaws match exactly the size of the nut or bolt which it is to turn Otherwise, the shoulders of the nut or bolt will be rounded and eventually render the bolt or nut unusable. Adjustable jaw wrenches have to be adjusted very accurately or they too will causing the rounding of the shoulders on the heads of bolts or nuts.

It is thus seen that there is a need for a wrench in which the exact fit between the wrench and the nut or bolt is not needed to prevent rounding of the corners.

SUMMARY OF THE INVENTION

This is an improved wrench having a handle, a fixed or first jaw fixed to the handle and a second jaw spaced from the fixed jaw. The second jaw may be either adjustable by being movable with respect to the fixed jaw or it may be a fixed distance from the fixed jaw. The first jaw and the second jaw each has a face which essentially faces the other. The face of the first jaw is modified so that it has a recess which is substantially arcuate in shape or contour. A swinging jaw is provided which has one edge having a contour matching or roughly mating with the contour of the first jaw. The second edge of the swinging jaw is planar and is essentially parallel to the face of the second jaw which is normally planar. The swinging jaw is held in the recess of the first fixed jaw by a pressure or connecting arm. The pressure arm permits limited movement between the swinging jaw and the first fixed jaw so that the swinging jaw can move toward the fixed jaw. Guide means are provided between the swinging jaw and the fixed or top jaw so that the swinging jaw will move in the desired motion with respect to the first jaw. Biasing means are provided against the presure arm to force the swinging jaws along the arcuate face of the top jaw away from the mouth of the wrench. When the tool is in operation, the force is on the inner end of the swinging jaw thus tending to force it toward the mouth of the wrench and in so doing the pressure arm as it pivots will force the swinging jaw into a closer relationship with the face of the other jaw.

It is thus an object of this invention to have a constrictor locking wrench system to compensate for a wrench not being the exact fit to match the nut or object which it is to rotate or hold.

DETAILED DESCRIPTION OF THE EMBODIMENT

Figure 1:
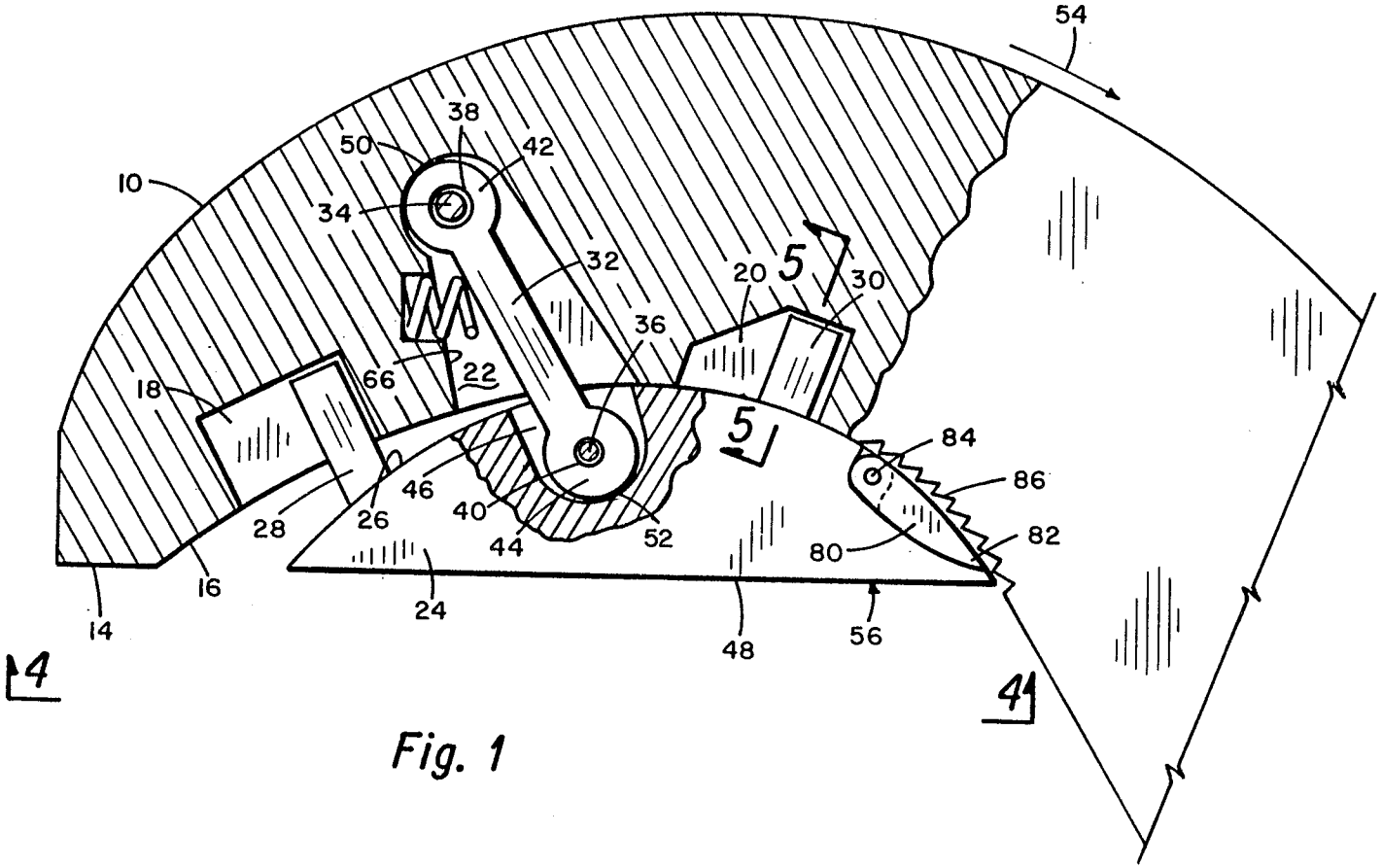
FIG. 1 illustrates partly in section the swinging jaw and how it is supported within the top jaw of a wrench.
Figure 3:
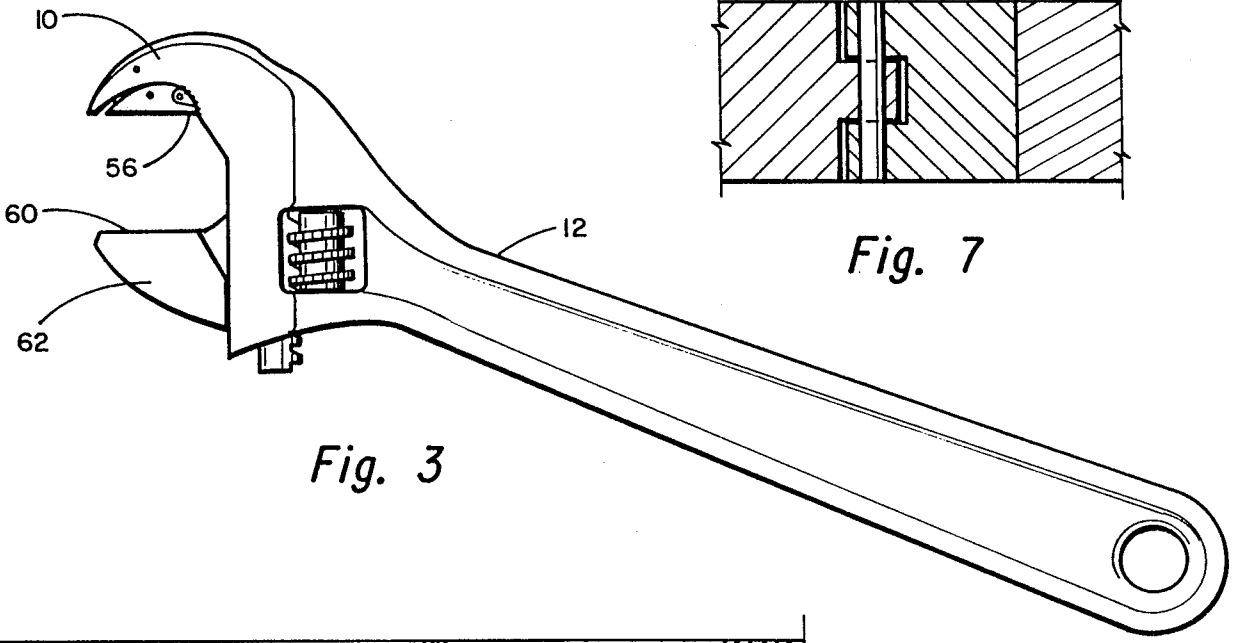
FIG. 3 shows an adjustable wrench with the fixed jaw modified to have my swinging jaw therein.
Figure 4:
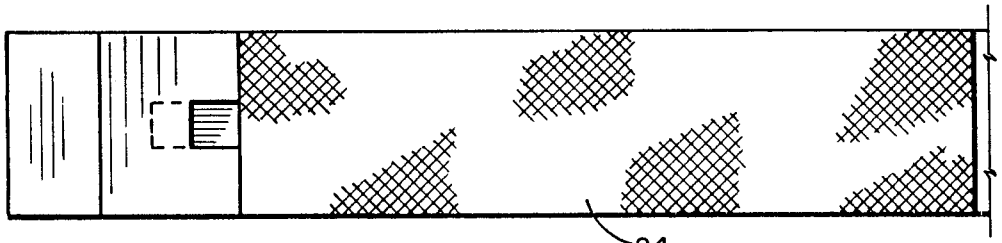
FIG. 4 is a view taken along the line 4—4 of FIG. 1.

Attention is first directed to FIG. 1 which shows a top or fixed jaw 10 of a wrench such as the adjustable wrench of FIG. 3. The wrench shown in FIG. 3 has an opening between jaw 62 and fixed jaw 10 which may be called a mouth of the wrench. The entry of the mouth is that part of the opening farthest removed from handle 12. My constrictor lock wrench system can be used for any type wrenches and is not to be limited to the adjustable wrench of FIG. 3. Attention is now directed back to FIG. 1. A lower face 14 has been modified or cut away to have generally an arcuate section 16. The arcuate section has a first guide slot 18 toward the outer end or mouth of the wrench and an inner guide slot 20. A pressure arm cavity 22 shaped somewhat like a key hole is also provided between the guide slots 18 and 20.

A swinging jaw 24 has a convex outer surface 26 which can ride along arcuate surface 16 of the jaw 10. It is preferred that the concave surface 16 and convex surface 26 are mating or matching arcuate sections.

Figure 5:
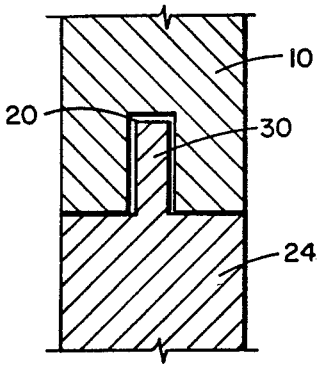
FIG. 5 is a view taken along the line 5—5 of FIG. 1.

Guide means are provided so that the swinging jaw will move along the concave surface 16. This includes guides 28 and 30 which respectively fit into guide slots 18 and 20. Slots 18 and 20 are located essentially in the middle of top jaw 10. This is shown clearly in FIG. 5. In FIG. 1 a part of the top jaw has been removed so that the various portions of the connection and guidance between the swinging jaw and the top jaw can be shown.

Figure 6:
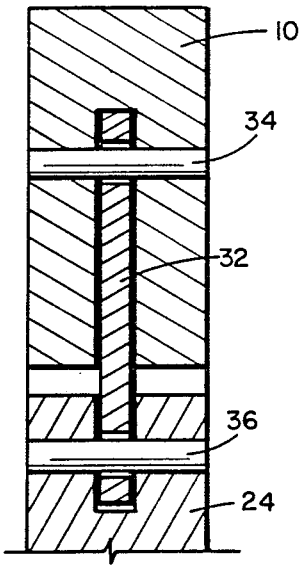
FIG. 6 is a view taken along the line 6—6 of FIG. 2.

Attention is now directed back to FIGS. 1 and to 6 which shows how the swinging jaw is actually held to jaw 10. This includes a connecting or pressure arm 32 which has an upper head 42 and a lower head 44. Pressure arm 32 extends into cavity 22 of the top jaw 10 and into cavity 46 of the swinging jaw. The upper head has a hole 38 and the lower head 44 has a hole 40. As clearly shown in FIG. 6 a pin 36 extends through the lower hole 40 and an upper pin 34 extends through upper hole 38. The cavity holes 38 and 40 and pins 34 and 36 are designed such that when force is applied against the face 48 of the swinging jaw 24, upper head 42 contacts the top jaw at pressure point 50 in cavity 22 and head 44 contacts pressure point 52 of the swinging jaw within cavity 46. Thus the forces transmitted through the pressure arm 32 between the pressure point 52 and pressure point 50. Thus the pivot pins 34 and 36 are not subject to the full force between the swinging jaw and the top jaw.

Figure 2:
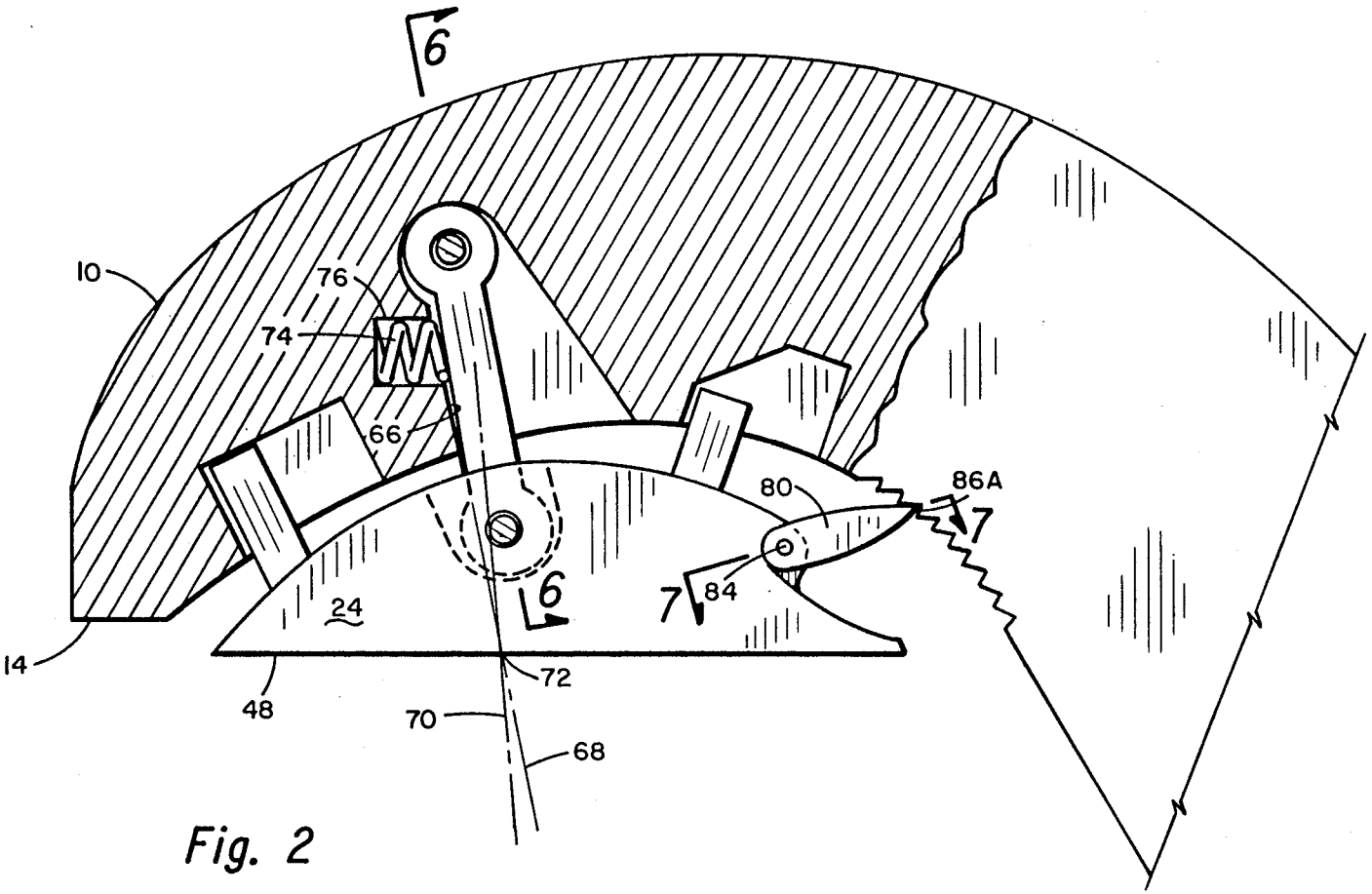
FIG. 2 is similar to FIG. 1, except that the swinging jaw has been moved to an adjusted position which is done automatically.
Figure 7:
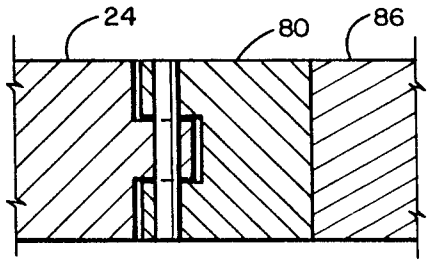
FIG. 7 is a view taken along the line 7—7 of FIG. 2.

In operation when my system is used with a wrench such as the adjustable wrench 12, force is applied clockwise in the direction of arrow 54. When this occurs the reaction force from the object being turned is on swinging jaw 24 and is concentrated toward the inner end away from the mouth of the wrench. This concentration is indicated by arrow 56. This force 56 will force the swinging jaw to pivot at pin 36. The force on the pin 36 will drive the swinging jaw 24 to the position shown in FIG. 2, assuming that the distance between face 48 and face 60 of jaw 62 of the wrench in FIG. 3 is slightly greater than the object on which it is to be placed. Then the swinging jaw 24 will move until the face 48 has a snug fit with the nut or other object upon which the wrench is placed. As can be seen in FIG. 2 the swinging jaw 24 has moved downwardly a distance "D" from the face 14 of the top jaw. This permits a snug fit although the wrench was not exactly adjusted. Means are provided to keep the swinging jaw 24 from extending too far. This is obtained by the angle "A" face 66 makes with the lower face 48 of swinging jaw 24. The plane defined by face 66 is extended as line 68 in FIG. 2. A line 70 has been drawn through face 48 perpendicular to face 48 at the point where it is intersected at the point 72 where line 68 intersects it. Line 70 is perpendicular to the line defined by face 48 in FIG. 2. Line 68 is less than perpendicular to line 48 so that the swinging jaw 24 will not lock into its furthermost position to the left when in the position viewed in FIG. 2. A spring 74 is provided in cavity 76 in fixed jaw 10 so that when the force is removed from swinging jaw 24 that the swinging jaw 24 will return to the position shown in FIG. 1.

Sometimes it will be desired to fix the position of swinging jaw 24 with respect to the jaw 10. This can be accomplished by use of lock 80 which has an end point 82 and a pivot 84. Lock teeth 86 are provided along the arcuate surface 16 of the fixed jaw 10. All one has to do is to shove the swinging jaw to the desired position and push lock 80 into the selected tooth 86A as illustrated in FIG. 2. Lock 80 is preferably provided with a friction pivot 84 so that a significant external force is required to move it from one position to the other. It is to be understood that the lock 80 need not be used in most normal operation.

Figure 8:
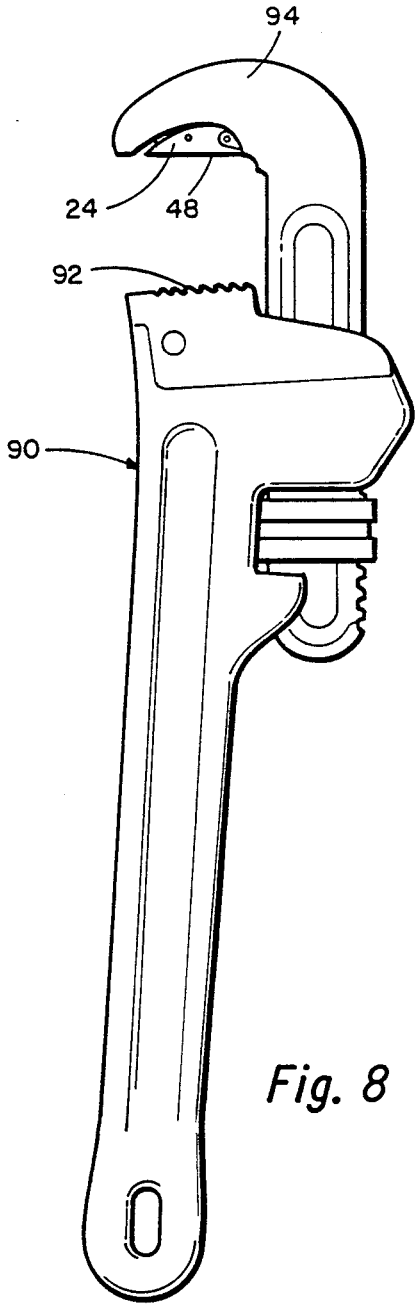
FIG. 8 illustrates my constrictor lock wrench system installed in a pipe wrench.

As mentioned before my constrictor lock wrench system can be used with most wrenches. In FIG. 8 it is shown used with a pipe wrench 90 having a fixed jaw with serrations 92 and a top or movable jaw 94 into which the swinging jaw 24 is installed such as shown in regard to FIGS. 1 and 3. The lower face 48 of swinging jaw 24 may have serrations such as those in 92 in the lower jaw. My system can also be used with other type wrenches such as the fixed common end wrenches. It is thus seen that my wrench can automatically adjust to different size objects such as nuts or bolts within the design limit so as to prevent rounding of corners of the nut or object.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved wrench having:

a handle;

a first jaw fixed to said handle and having a face having an arcuate contour surface on an edge;

a second jaw supported from said handle and spaced from said first jaw;

a swinging jaw having a convex surface contacting said arcuate contour surface and also having a second edge which is planar;

only one pressure arm supporting said swinging jaw from said first jaw;

a mouth formed between said first and second jaws and having an entry; and means to bias said pressure arm in a direction away from the entry of the mouth of the wrench toward its handle.

2. A wrench as defined in claim 1 in which said pressure arm is supported from said first jaw by a pin in a key hole shaped cavity therein opening into said arcuate contour surface and the other end of said pressure arm is supported from a pin supported in a cavity within said swinging jaw.

3. A wrench as defined in claim 1 including guide means for guiding said swinging jaw along the arcuate contour surface.

4. A wrench as defined in claim 3 including locking means to lock said swinging jaw in a selected position with respect to said first jaw.

5. A wrench as defined in claim 4 in which said second jaw is adjustable with respect to said first jaw.

6. A wrench as defined in claim 5 in which said cavity in said first jaw has two planar surfaces in which first surface is closer to the mouth of said wrench and makes an angle "A" with the planar face of said swinging jaw measured from the mouth of the wrench which is less than perpendicular to prevent the swinging arm from locking into its furthermost position away from said handle.

7. A wrench as defined in claim 6 in which the angle "A" is at least twenty or thirty degrees less than the perpendicular angle.

8. A wrench as defined in claim 5 including holes in the heads of said pressure arm which are sufficiently larger than the connecting pins so that the outer ends of the heads can contact respectively the first jaw and the swinging jaw so that force can be transmitted directly from the swinging jaw through the pressure arm to the first jaw.

9. A wrench as defined in claim 3 in which said guide means includes a first cavity on one side of said pressure arm and a second cavity on the other side of said pressure arm, said second cavity being farther from the opening of the mouth of the wrench than said first cavity;

a first guide pin and a second guide pin fixed to said swinging jaw and arranged to enter respectively said first and second cavity, a portion of said second cavity being as deep from arcuate contour surface as the length of said second pin and a portion of the cavity being of a depth less than the length of the pin.

10. An improved wrench having:

a handle;

a first jaw fixed to said handle and having a face having an arcuate contour surface on an edge;

a second jaw suppoted from said handle and spaced from said first jaw;

a swinging jaw having a convex surface contacting said arcuate contour surface and also having a second edge which is planar;

supporting means supporting said swinging jaw from said first jaw such that said swinging jaw contacts said arcuate contour surface of said first jaw;

a mouth defined between said first jaw and said second jaw and having an entry away from said handle; and biasing means to bias said support means in a direction away from the entry of the mouth of the wremch to force the swinging jaw along the arcuate face of the top jaw away from the entry of the mouth of the wrench toward said handle.

* * * * *